US007641279B1

(12) United States Patent
Curcio

(10) Patent No.: US 7,641,279 B1
(45) Date of Patent: Jan. 5, 2010

(54) STORAGE COMPARTMENT FOR A CHAIR

(76) Inventor: Mark Curcio, 119 Saddlebrook, Oakbrook, IL (US) 60521

( * ) Notice: Subject to any disclaimer, the term of this patent is extended or adjusted under 35 U.S.C. 154(b) by 5 days.

(21) Appl. No.: 12/137,652

(22) Filed: Jun. 12, 2008

(51) Int. Cl.
*A47C 7/62* (2006.01)

(52) U.S. Cl. ..... 297/188.18; 297/188.19

(58) Field of Classification Search ..... 220/210, 220/601, 212, 751; 297/188.18, 188.19, 297/188.2, 411.2, 188.14, 188.17, 188.16, 297/188.13, 227
See application file for complete search history.

(56) References Cited

U.S. PATENT DOCUMENTS

| | | | | |
|---|---|---|---|---|
| 1,550,055 | A | 8/1925 | Augustine | |
| 2,419,412 | A * | 4/1947 | McArthur | 297/411.26 |
| 3,042,467 | A | 7/1962 | Germick | |
| 3,455,498 | A | 7/1969 | Gadiel | |
| 3,734,335 | A * | 5/1973 | Lincoln | 220/4.21 |
| 4,674,303 | A * | 6/1987 | Salcone, II | 70/63 |
| 4,730,869 | A | 3/1988 | Schumacher | |
| 5,074,617 | A | 12/1991 | Maxwell | |
| D396,736 | S * | 8/1998 | Davis | D2/639 |
| 5,797,655 | A | 8/1998 | Miles | |
| 6,257,661 | B1 | 7/2001 | Eberle | |
| 6,652,024 | B2 | 11/2003 | Prasatek | |
| 7,249,799 | B2 * | 7/2007 | Luce | 297/188.18 |
| 7,278,681 | B2 * | 10/2007 | Lilov et al. | 297/188.17 |

OTHER PUBLICATIONS

U.S. Statutory Invention Reg. No. H1382, Published on Dec. 6, 1994, 4 pages.

* cited by examiner

*Primary Examiner*—Milton Nelson, Jr.
(74) *Attorney, Agent, or Firm*—Wildman, Harrold, Allen & Dixon LLP

(57) ABSTRACT

A storage compartment and method of locking the storage compartment to an arm rest of a chair are provided. The storage compartment may include a housing having a cavity for receiving articles and a cover movable relative to the housing between a closed position and an open position. Openings may be defined in opposing sides of at least one of the housing and the cover for receiving an arm rest of a chair. The storage compartment may also include a locking mechanism moveable between a locked condition and an unlocked condition such that the housing and cover can be positioned around an arm rest of a chair and the locking mechanism can prevent removal of the storage compartment from the arm rest.

33 Claims, 6 Drawing Sheets

STORAGE COMPARTMENT FOR A CHAIR

FIELD OF THE INVENTION

This invention relates generally to storage compartments for chairs and, more particularly, to storage compartments selectively lockable to arm rests of beach chairs.

BRIEF SUMMARY

In one example, a storage compartment is provided and includes a housing having a cavity for receiving articles, and a cover movable relative to the housing between a closed position, in which the cavity is covered and the cavity is not accessible, and an open position, in which the cavity is not covered and the cavity is accessible, the openings being defined in opposing sides of at least one of the housing and the cover for receiving an arm rest of a chair.

In another example, a storage compartment is provided and includes a housing having a cavity for receiving articles, a cover movable relative to the housing between a closed position, in which the cavity is covered and the cavity is not accessible, and an open position, in which the cavity is not covered and the cavity is accessible, and a locking mechanism connected to at least one of the housing and the cover, and being moveable between a locked condition, in which the cover is in the closed position and is prevented from moving out of the closed position, and an unlocked condition, in which the cover can move between the open and closed positions, the housing and cover being positionable around an arm rest of a chair such that the locking mechanism prevents removal of the storage compartment from the arm rest.

In yet another example, a method of locking a storage compartment on an arm rest of a chair is provided and includes providing the storage compartment including a housing, a cover, and a locking mechanism, the housing having a cavity for receiving articles and the cover being movable relative to the housing between a closed position, in which the cavity is covered and the cavity is not accessible, and an open position, in which the cavity is not covered and the cavity is accessible. The method also including positioning the cover and housing around the arm rest of the chair and locking the cover to the housing with the locking mechanism to prevent removal of the storage compartment from the arm rest.

Independent features and independent advantages will become apparent to those skilled in the art upon review of the detailed description and drawings.

Figure 1:
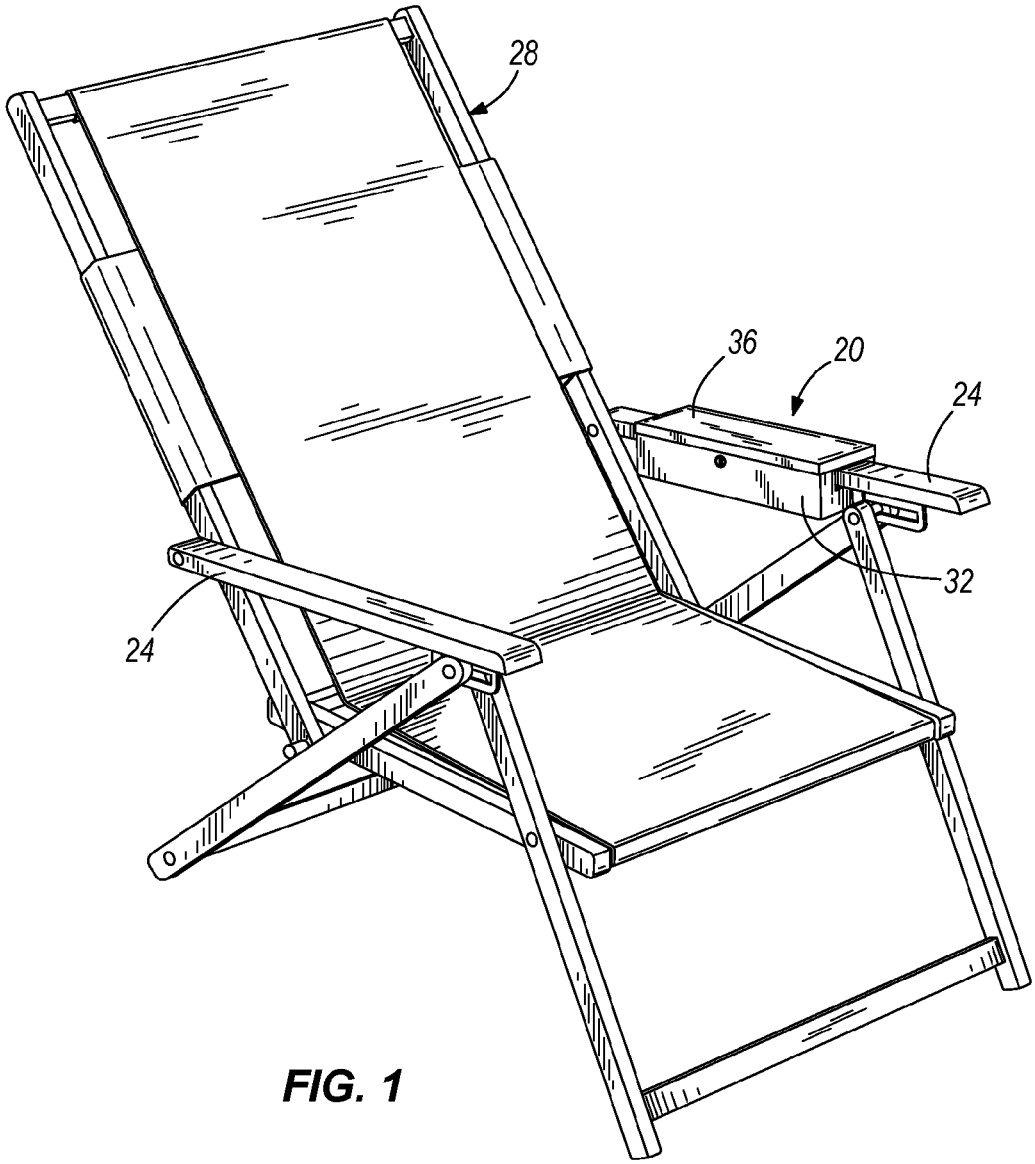
FIG. 1 is a perspective view of an exemplary chair and storage compartment.

It is to be understood that the invention is not limited in its application to the details of the construction and the arrangement of the components set forth in the following description or illustrated in the drawings. The invention is capable of other embodiments and of being practiced or of being carried out in various ways. Also, it is understood that the phraseology and terminology used herein is for the purpose of description and should not be regarded as limiting.

DETAILED DESCRIPTION

Referring to FIG. 1, an exemplary storage compartment 20 is connected to an arm rest 24 of an exemplary chair 28. In the illustrated example, the chair 28 is a beach chair or lawn chair, but can be other types of chairs that include arm rests 24. The storage compartment 20 provides a user a place to store valuables or other articles and allows the user to lock the storage compartment 20 to the arm rest 24 of the chair 28 to inhibit theft or loss of the valuables or articles stored within the storage compartment 20.

Figure 2:
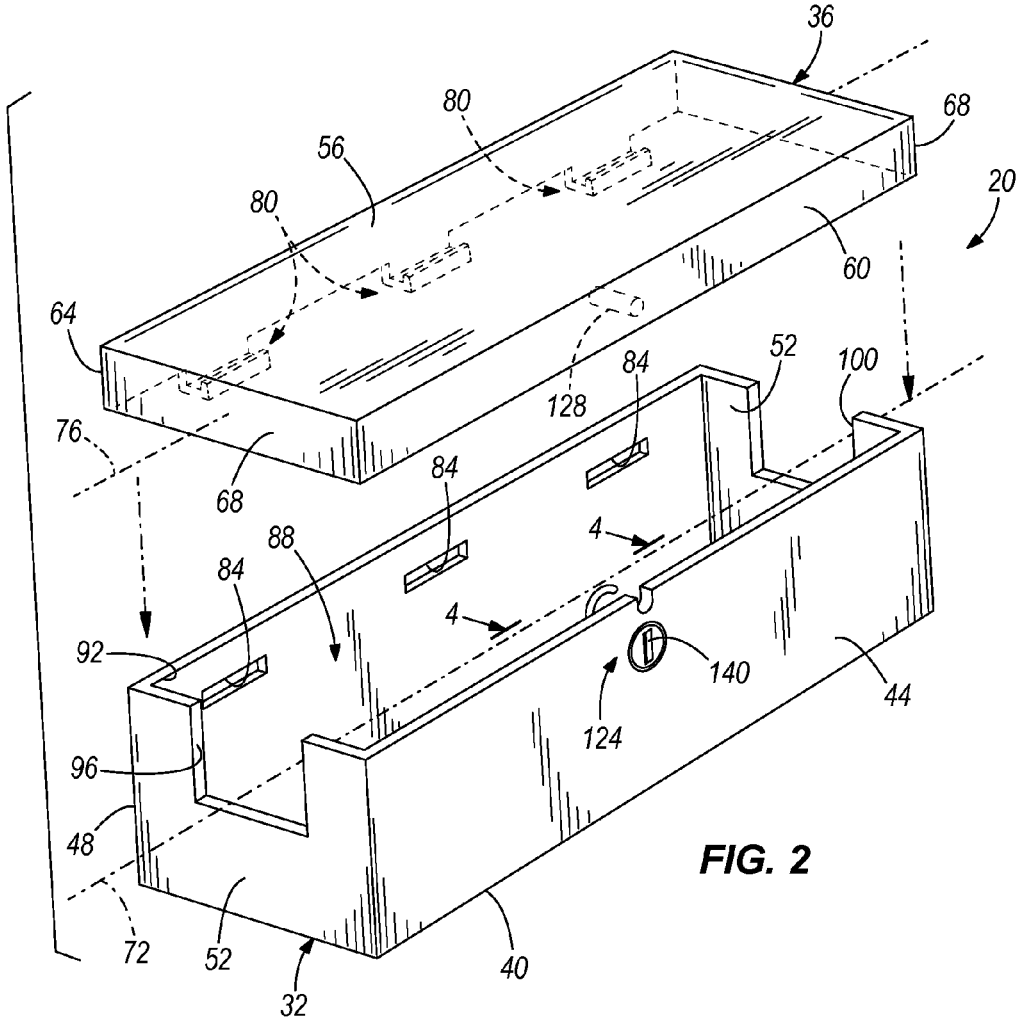
FIG. 2 is an exploded view of the exemplary storage compartment shown in FIG. 1.

With continued reference to FIG. 1 and additional reference to FIG. 2, the storage compartment 20 includes a housing 32 and a cover 36. The housing 32 includes a bottom 40, a front 44, a back 48, and two sides 52 and the cover 36 includes a top 56, a front 60, a back 64, and two sides 68. In the illustrated example, the housing 32 and the cover 36 have a rectangular shape (i.e., one dimension, such as the length from side to side, is greater than a second dimension, such as the depth from front to back) and each extends longitudinally along a respective longitudinal axis 72, 76 extending through and substantially perpendicular to the respective sides 52, 68 of the housing 32 and the cover 36. Also, the illustrated example of the cover 36 is removably connected to the housing 32 and includes a plurality of connectors 80 interacting with a plurality of apertures 84 defined in the housing 32 to removably connect the cover 36 to the housing 32. Alternatively, the cover 36 may be removably connected to the housing 32 in a variety of other manners such as, for example, a hinge 80B (see FIG. 7). The housing 32 forms a cavity 88 defined by the bottom 40, front 44, rear 48, and two sides 52 and a cavity opening 92 on top to provide access to the cavity 88. The cavity opening 92 facilitates placement and removal of valuables into and from the cavity 88. The cover 36 is movable between a closed position (see FIG. 1) and an open position (see FIG. 2). In the closed position, the cover 36 is connected to the housing 32 via connectors 80 and the cavity opening 92 is covered to prevent access to the cavity 88, thereby preventing placement of articles into the cavity 88 and removal of articles from the cavity 88. In the open position, the cover 36 is removed from the housing 32, thereby exposing the cavity opening 92 and facilitating access to the cavity 88 in order to place articles in the cavity 88 or remove articles from the cavity 88.

With continued reference to FIGS. 1 and 2, a first opening 96 and a second opening 100 are defined respectively in each side 52 of the housing 32. The first and second openings 96, 100 are appropriately sized and shaped to receive therein the arm rest 24 of the chair 28. In the illustrated embodiment, the first and second openings 96, 100 are substantially rectangular in shape for receiving an arm rest 24 having a similar rectangular shape. Alternatively, the first and second openings 96, 100 can assume a variety of different shapes such as, for example, semi-circular (see FIG. 9), triangular, arcuate, stepped, or any other polygonal or non-polygonal shapes, in order to facilitate connection of the storage compartment 20 to arm rests 24 of substantially any shape.

Figure 3:
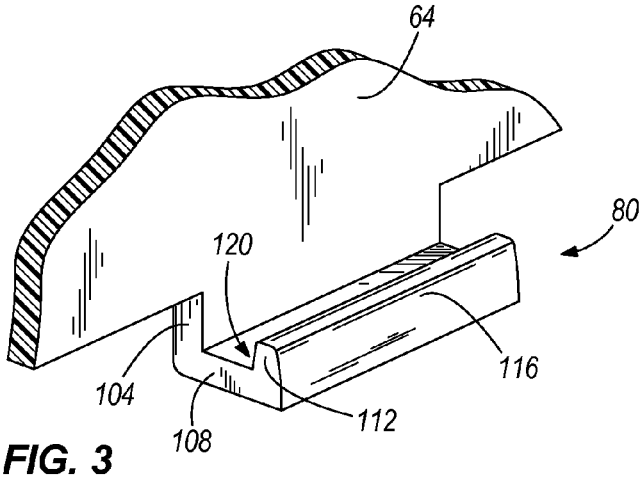
FIG. 3 is an enlarged partial perspective view of a connector of the storage compartment.

Referring now to FIGS. 2 and 3, the connectors 80 extend from the rear 64 of the cover 36 and all have substantially the same structure. Accordingly, only one of the connectors 80 will be described herein in detail. The connector 80 includes a first vertical portion 104, a horizontal portion 108, and a second vertical portion 112. The first vertical portion 104 extends downwardly from the rear 64 of the cover 36, the horizontal portion 108 extends from an end of the first vertical portion 104 in a direction toward the front 60 of the cover 36, and the second vertical portion 112 extends upwardly from the other end of the horizontal portion 108. The second vertical portion 112 has a ramped surface 116 and together with the horizontal portion 108 forms a lip 120. The ramped surface 116 eases entry into the corresponding aperture 84 defined in the housing 32 and the lip 120 assists with securing the connector 80 to the housing 32 within the aperture 84, both of which will be described in greater detail below. In other constructions, the connector 80 could have different shapes relative to each other or the storage compartment 20 could only include a singe connector 80.

Figure 4:
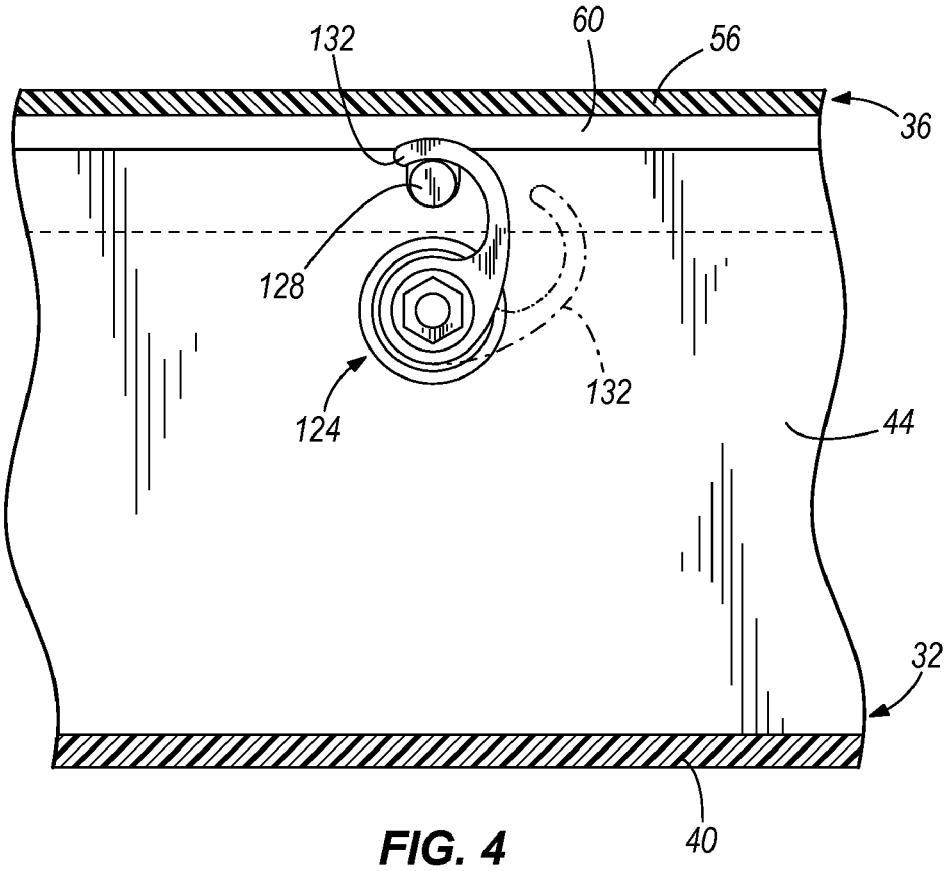
FIG. 4 is a partial cross-sectional view of an exemplary locking mechanism of the storage compartment taken across line 4-4 in FIG. 2.
Figure 5:
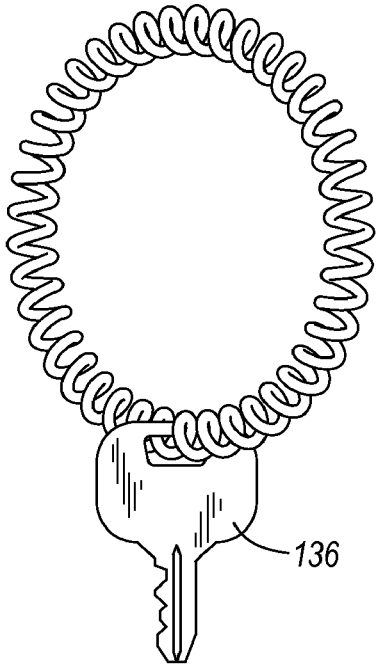
FIG. 5 is an exemplary device for moving the locking mechanism shown in FIG. 4 between a locked condition and an unlocked condition.

With reference to FIGS. 1-5, the storage compartment 20 also includes a locking mechanism 124 for locking the cover 36 to the housing 32 and preventing the cover 36 from being removed from the housing 32, such as a barrel lock or other suitable locking mechanism. In the illustrated example, the locking mechanism 124 includes a projection 128 connected to an interior surface of the front 60 of the cover 36 and a latch 132 pivotally connected to the front 44 of the housing 32. Alternatively, the projection 128 can be connected to the housing 32 and the latch 132 can be pivotally connected to the cover 36. The latch 132 is pivotal relative to the housing 32 by inserting a key 136 into a key slot 140 of the latch 132 and turning the key 136. With particular reference to FIG. 4, the latch 132 is pivotal between a locked condition (shown in solid lines in FIG. 4) and an unlocked condition (shown in dashed lines in FIG. 4). In the locked condition, the latch 132 engages the projection 128 when the cover 36 is in the closed position and prevents the cover 36 from moving out of the closed position. In the unlocked position, the latch 132 is moved out of engagement with the projection 128 and the cover 36 is free to move between the closed and open positions.

Operation of the storage compartment 20 will now be described. Since the storage compartment 20 is a separate element from the chair 28, a user may carry the storage compartment 20 with him/her from place to place until the user decides to connect it to an arm rest 24 of a chair 28. When the user decides to connect the storage compartment 20 to an arm rest 24, the user unlocks the locking mechanism 124 with the appropriate key 136 by inserting the key 136 into the key slot 140 and turning the key 136 to rotate the latch 132 to the unlocked condition, thereby allowing the cover 36 to move from the closed position to the open position. With respect to the illustrated storage compartment 20, the cover 36 is completely removed from the housing 32 by removing the connectors 80 of the cover 36 from the apertures 84 of the housing 32. When the cover 36 is in the open position, the user may place articles into or remove articles from the cavity 88 of the housing 32 as desired. Then, the user positions the housing 32 under the arm rest 24 of the chair 28 such that the first and second openings 96, 100 align with the arm rest 24, and the user moves the housing 32 upward to position the arm rest 24 in the first and second openings 96, 100. The user then positions the cover 36 over the arm rest 24 and housing 32, and connects the cover 36 to the housing 32 by inserting the connectors 80 into the apertures 84 of the housing 32. The ramped surface 116 of the connectors 80 eases insertion of the connectors 80 into the apertures 84 and the lip 120 engages the back 48 of the housing 32 to inhibit removal of the connectors 80 from the apertures. When the cover 36 is connected to the housing 32, the cover 36 is in the closed position, thereby trapping the arm rest 24 in the first and second openings 96, 100 between the housing 32 and the cover 36. The key 136 is rotated to move the locking mechanism 124 from the unlocked condition to the locked condition to lock the cover 36 to the housing 32, which locks the storage compartment 20 to the arm rest 24 of the chair 28 to prevent removal of the storage compartment 20 from the arm rest 24 and to prevent access to the articles inside the storage compartment 20. To allow access to the articles inside the storage compartment 20 and/or to remove the storage compartment 20 from the arm rest 24, a user need only reverse the steps described above.

Figure 6:
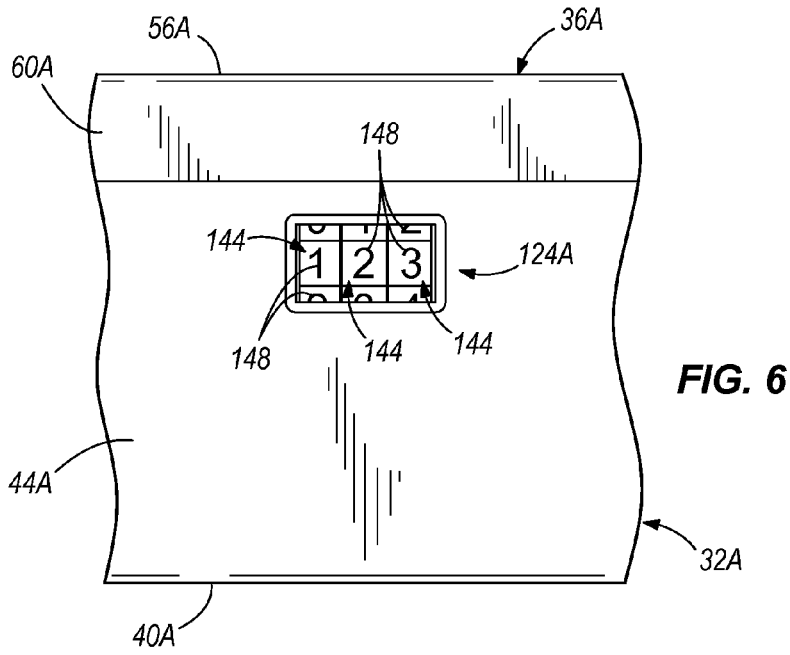
FIG. 6 is a partial front view of another exemplary storage compartment including another exemplary locking mechanism.

With reference to FIG. 6, another exemplary storage compartment is illustrated. Components of the storage compartment illustrated in FIG. 6 that are similar to components of the storage compartment 20 illustrated in FIGS. 1-5 and are identified with the same reference number and an "A". The storage compartment shown in FIG. 6 includes an alternative locking mechanism 124A to that illustrated in FIGS. 1-5. More particularly, the storage compartment includes a combination-style locking mechanism 124A, which requires an access code in order to unlock the combination locking mechanism 124A. The illustrated combination locking mechanism 124A includes a plurality of rotatable dials 144, each having a plurality of numbers 148 thereon. The combination locking mechanism 124A is in the unlocked condition when the dials 144 are rotated to particular positions to align the numbers 148 that comprise the access code. When the access code is entered into the combination locking mechanism 124A, the cover 36A is free to move between the closed and open positions. To move the combination locking mechanism 124A to the locked condition, the cover 36A is placed in the closed position and the dials 144 are rotated to unalign the access code numbers 148, thereby removing the access code from being entered. In the locked condition, the cover 36A is prevented from moving out of the closed position. While only two types of locking mechanisms are illustrated and described herein, it should be understood that other types of locking mechanisms can be used to selectively lock the storage compartment.

While the exemplary storage compartments illustrated in FIGS. 1-6 include a cover 36, 36A removable from the housing 32, 32A, other exemplary storage compartments can include a cover 36B that is not readily removable from the housing 32B. For example and with reference to FIG. 7, another exemplary storage compartment 20B is illustrated and includes a different type of connector 80B for pivotally connecting the cover 36B to the housing 32B. The illustrated connector in this example is a hinge 80B. Components of the storage compartment 20B illustrated in FIG. 7 that are similar to components of the storage compartments illustrated in FIGS. 1-6 are identified with the same reference number and a "B". In this construction, the cover 36B is pivotal between the closed position, in which the cover 36B covers the cavity opening 92B to prevent access to the cavity 88B, and the open position, in which the cover 36B is pivoted upward and away from the housing 32B, thereby exposing the cavity opening 92B and facilitating access to the cavity 88B in order to place articles in the cavity 88B or remove articles from the cavity 88B. While only two types of connectors are illustrated and described herein, it should be understood that other types of connectors can be used to connect the cover to the housing. For example, other types of connectors include, but are not limited to, a living hinge, etc.

Operation of the storage compartment 20B illustrated in FIG. 7 will now be described. Similar to the storage compartment 20 illustrated in FIGS. 1-5, the storage compartment 20B is a separate element from the chair 28 and a user may carry the storage compartment 20B with him/her from place to place until the user decides to connect it to an arm rest 24 of a chair 28. When the user decides to connect the storage compartment 20B to an arm rest 24, the user unlocks the locking mechanism 124B with the appropriate key 136 by inserting the key 136 into the key slot 140B and turns the key 136 to rotate the latch 132B to the unlocked condition, thereby allowing the cover 36B to move from the closed position to the open position. In this construction of the storage compartment 20B, the cover 36B is pivoted upward away from the housing 32B to move the cover 36B from the closed position to the open position. When the cover 36B is in the open position, the user may place articles into or remove articles from the cavity 88B of the housing 32B as desired. Then, the user positions the housing 32B under the arm rest 24 of the chair 28 such that the first and second openings 96B, 100B align with the arm rest 24, and the user moves the housing 32B upward to position the arm rest 24 in the first and second openings 96B, 100B. The user then pivots the cover 36B downwardly toward the arm rest 24 to the closed position. When the cover 36B is in the closed position, the arm rest 24 is trapped in the first and second openings 96B, 100B between the housing 32B and the cover 36B. The key 136 is rotated to move the locking mechanism 124B from the unlocked condition to the locked condition to lock the cover 36B to the housing 32B, which locks the storage compartment 20B to the arm rest 24 of the chair 28 to prevent removal of the storage compartment 20B from the arm rest 24 and to prevent access to the articles inside the storage compartment 20B. To allow access to the articles inside the storage compartment 20B and/or to remove the storage compartment 20B from the arm rest 24, a user need only reverse the steps described above.

Figure 7:
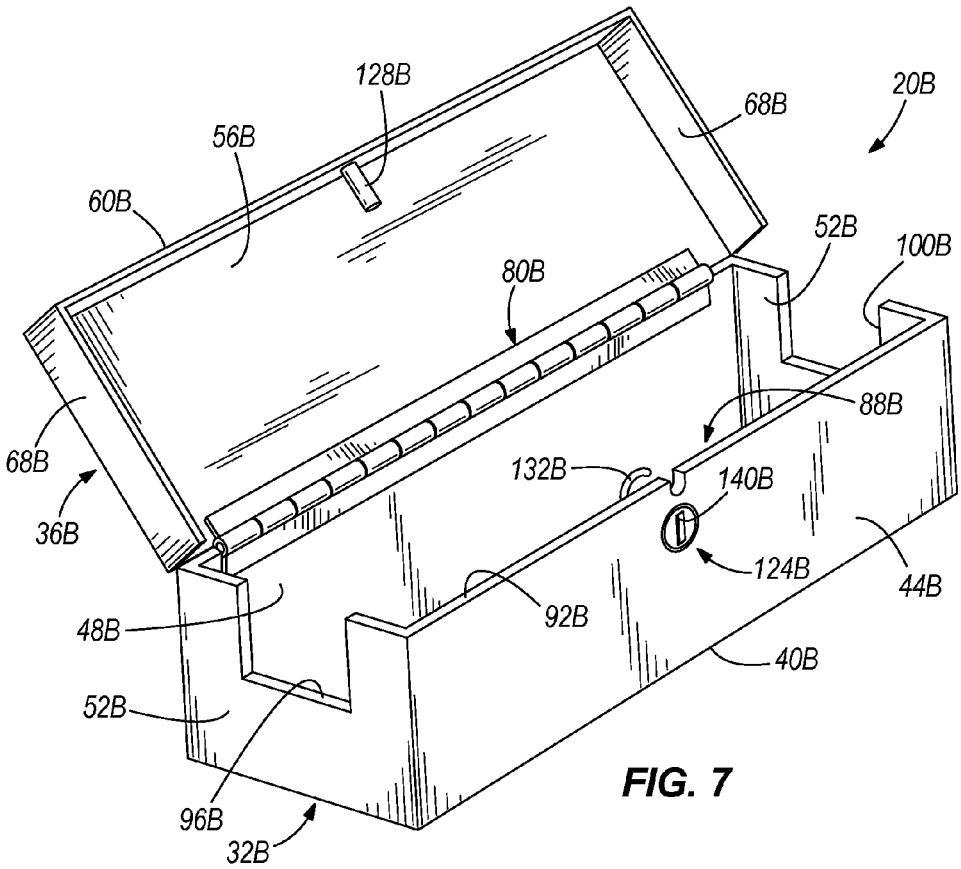
FIG. 7 is a perspective view of another exemplary storage compartment including another exemplary connector.
Figure 8:
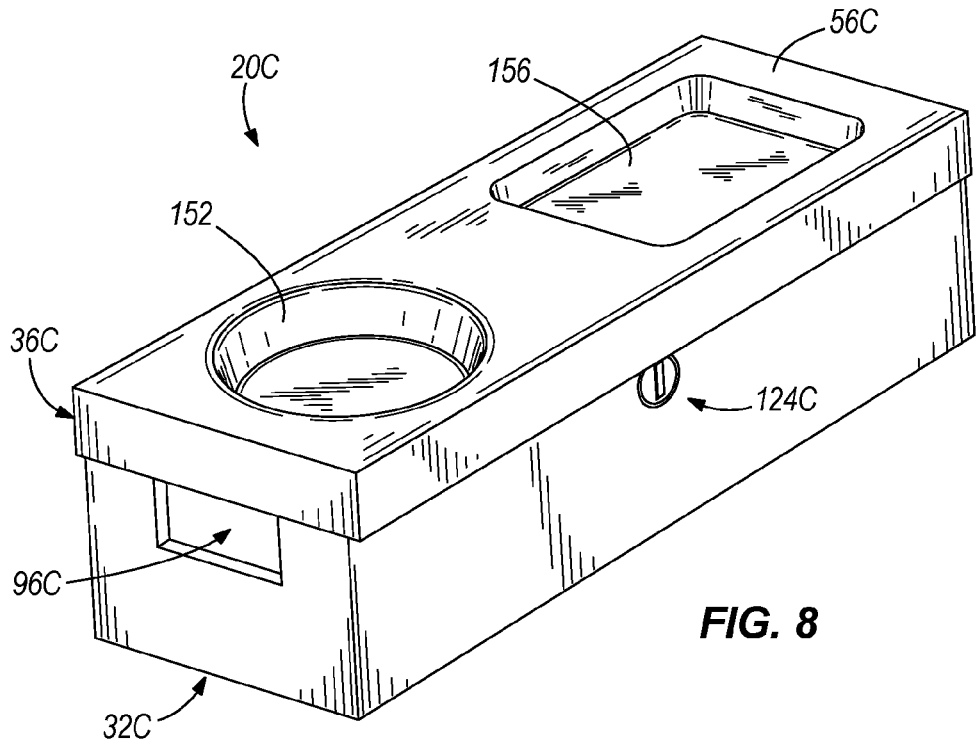
FIG. 8 is a perspective view of another exemplary storage compartment with an alternative cover.

Referring now to FIG. 8, another exemplary storage compartment 20C is illustrated. Components of the storage compartment 20C illustrated in FIG. 8 that are similar to components of the storage compartments illustrated in FIGS. 1-7 are identified with the same reference number and a "C". The storage compartment 20C includes a first depression 152 and a second depression 156 in the top 56C of the cover 36C for receiving and supporting articles therein. In the illustrated construction, the first depression 152 is shaped and sized to receive a cup or other round-shaped container for containing comestible liquids, and the second depression 156 is substantially rectangular for receive any articles that will fit therein. Some exemplary articles may include, but are not limited to, keys, change, wallet, sunscreen bottle, camera, etc. Typically, the second depression 156 is used to contain articles when a user is nearby and able to monitor the contents therein. When a user is unable to monitor the contents, the user may wish to place the articles in the cavity 88C of the housing 32C and lock the storage compartment 20C. While only two depressions 152, 156 are illustrated and described herein, it should be understood that the storage compartment can include any number of depressions in the cover or other surfaces thereof and it should be understood that the depressions can assume any shape, such as, for example, triangular, oval, or any other polygonal shape, to receive and support a large variety of articles.

Figure 9:
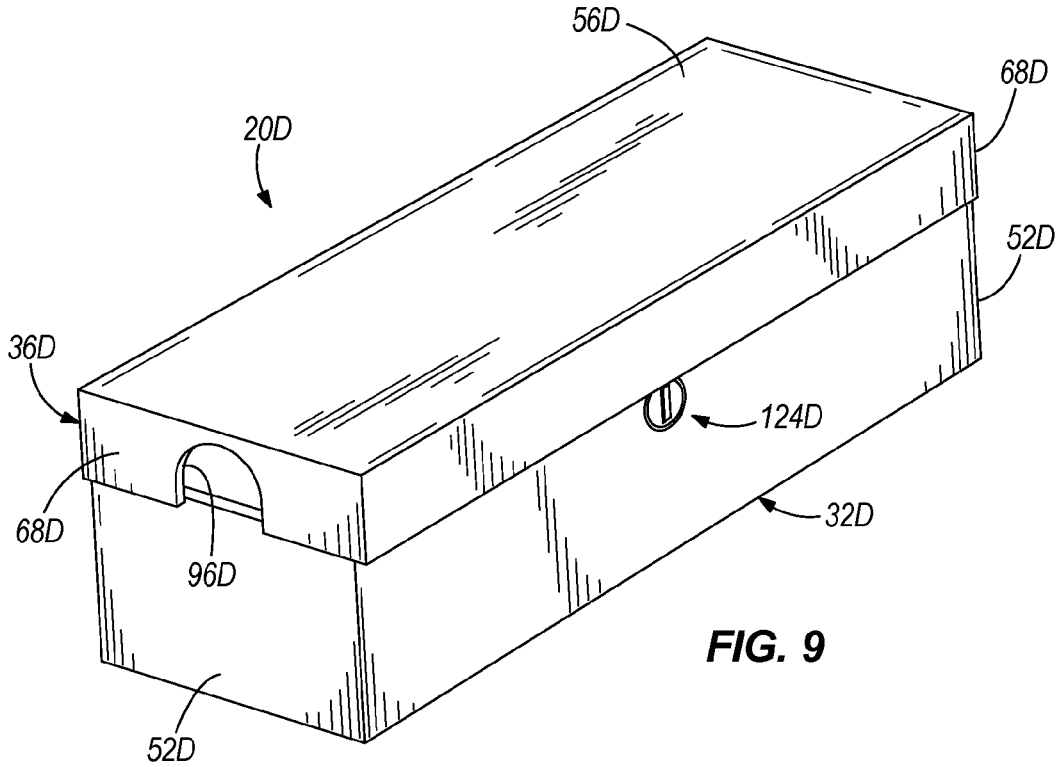
FIG. 9 is a perspective view of another exemplary storage compartment, shown with an opening defined in a cover of the storage compartment and the opening having another exemplary shape.

With reference to FIG. 9, another exemplary storage compartment 20D is illustrated. Components of the storage compartment 20D illustrated in FIG. 9 that are similar to components of the storage compartments illustrated in FIGS. 1-8 are identified with the same reference number and a "D". In this example, a first opening 96D and a second opening 100D (not shown) are defined respectively in each side 68D of the cover 36D, rather than in the sides 52D of the housing 32D as illustrated in the storage compartment 20 of FIGS. 1-5. The first and second openings 96D, 100D are appropriately sized and shaped to receive therein the arm rest 24 of a chair 28. In this construction, the first and second openings 96D, 100D have a semi-circular shape for receiving an arm rest 24 having a similar semi-circular shape. Alternatively, the first and second openings 96D, 100D can assume a variety of different shapes such as, for example, rectangular, triangular, arcuate, stepped, or any other polygonal or non-polygonal shapes, in order to facilitate connection of the storage compartment 20D to arm rests 24 of substantially any shape.

Operation of the storage compartment 20D is similar to the operation of the storage compartment 20 illustrated in FIGS. 1-5 or the storage compartment 20B illustrated in FIG. 7 depending on the type of connector connecting the cover 36D to the housing 32D. A difference in operation of the storage compartment 20D includes positioning the arm rest 24D in the first and second openings 96D, 100D of the cover 36D instead of first and second opening of housing 32D.

Figure 10:
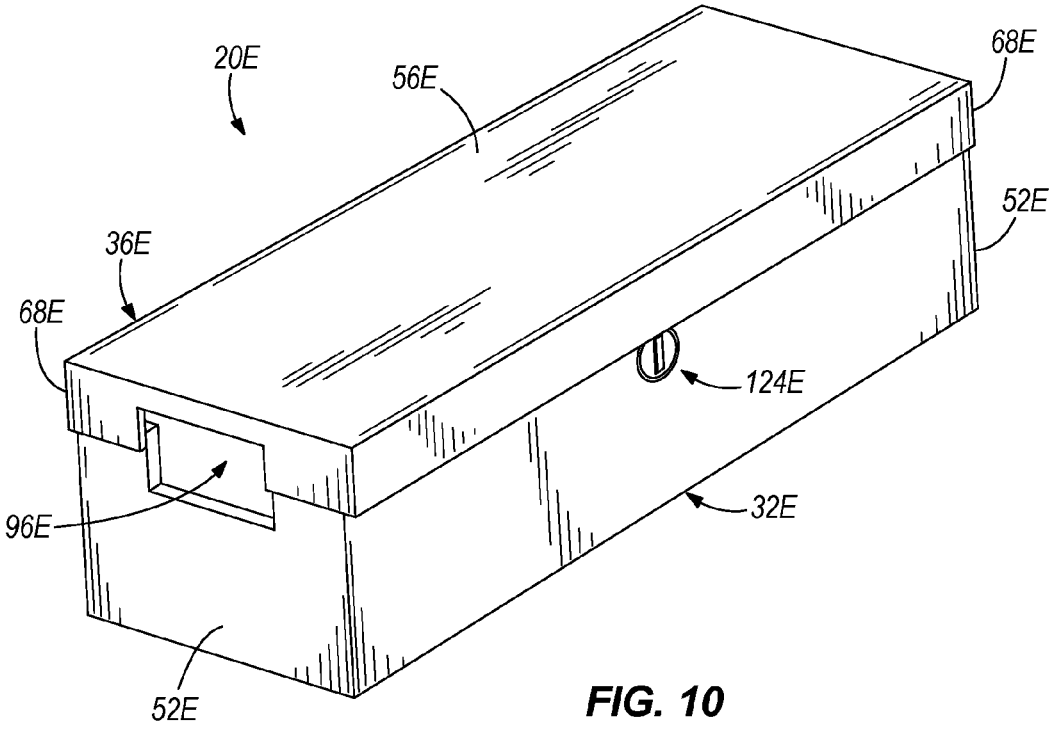
FIG. 10 is a perspective view of another exemplary storage compartment, shown with an opening defined by both a cover and a housing of the storage compartment.

With reference to FIG. 10, another exemplary storage compartment 20E is illustrated. Components of the storage compartment 20E illustrated in FIG. 10 that are similar to components of the storage compartments illustrated in FIGS. 1-9 are identified with the same reference number and an "E". In this example, a first opening 96E is partially defined in a first side 68E of the cover 36E and partially defined in a first side 52E of the housing 32E, and a second opening 100E (not shown) is partially defined in a second side 68E of the cover 36E and is partially defined in a second side 52E of the housing 32E, rather than being completely defined in sides of either the housing or the cover as illustrated in the storage compartments of FIGS. 1-9. The housing 32E and cover 36E cooperate to define the first and second openings 96E, 100E, such that they are appropriately sized and shaped to receive therein the arm rest 24 of a chair 28. Similarly to the first and second openings of the storage compartments of FIGS. 1-8, the first and second openings 96E, 100E are substantially rectangular in shape for receiving an arm rest 24 having a similar rectangular shape, but, alternatively, the first and second openings 96E, 100E can assume a variety of different shapes such as, for example, semi-circular (see FIG. 9), triangular, arcuate, stepped, or any other polygonal or non-polygonal shapes, in order to facilitate connection of the storage compartment 20E to arm rests 24 of substantially any shape.

Operation of the storage compartment 20E is similar to the operation of the storage compartments illustrated in FIGS. 1-6 and 8 or the storage compartment 20B illustrated in FIG. 7 depending on the type of connector connecting the cover 36E to the housing 32E. In this construction, the first and second openings 96E, 100E are defined in part by both the housing 32E and the cover 36E, rather than only in the housing 32E or only in the cover 36E, and the arm rest 24 is positioned in the first and second openings 96E, 100E of both the housing 32E and the cover 36E.

It should be understood that the first and second openings can be defined in a portion of the cover, a portion of the housing, or both the cover and the housing and can assume any shape in order to accommodate any sized and shaped arm rest of any chair.

The foregoing description of the preferred embodiment of the invention has been presented for purposes of illustration and description, and is not intended to be exhaustive or to limit the invention to the precise form disclosed. The descriptions were selected to best explain the principles of the invention and their practical application to enable other skills in the art to best utilize the invention in various embodiments and various modifications as are suited to the particular use contemplated. Although particular constructions of the present invention have been shown and described, other alternative constructions will be apparent to those skilled in the art and are within the intended scope of the present invention. It is intended that the scope of the invention not be limited by the specification or drawings, but be defined by the claims set forth below.

What is claimed is:

1. A combination, comprising:

a chair including an armrest; and a storage compartment including a housing having a cavity for receiving articles and a cover movable relative to the housing between a closed position, in which the cavity is covered and the cavity is not accessible, and an open position, in which the cavity is not covered and the cavity is accessible;

wherein openings are defined in opposing sides of at least one of the housing and the cover for receiving the arm rest; and wherein the arm rest is trapped in the openings when the cover is in the closed position, and wherein the arm rest can move into and out of the openings when the cover is in the open position.

2. The combination of claim 1, wherein the openings are defined in the sides of the housing.

3. The combination of claim 1, wherein the openings are defined in the sides of the cover.

4. The combination of claim 1, wherein the openings are partially defined in the sides of the cover and partially defined in the sides of the housing.

5. The combination of claim 1, wherein the openings are substantially aligned with each other along an axis.

6. The combination of claim 5, wherein the axis is a longitudinal axis of the storage compartment.

7. The combination of claim 1, further comprising a locking mechanism connected to one of the housing and the cover, the locking mechanism having a locked condition, in which the cover is in the closed position, the arm rest is positioned in the openings, and the cover is prevented from moving out of the closed position, and an unlocked condition, in which the cover can move between the open and closed positions and the arm rest is removable from the openings.

8. The combination of claim 1, further comprising a connector for connecting the cover to the housing.

9. The combination of claim 8, wherein the connector is a hinge, the cover being pivotably connected to the housing and pivotable between the open and closed positions.

10. The combination of claim 8, wherein the housing includes an opening, and wherein the connector is removably positionable in the opening to removably connect the cover to the housing.

11. The combination of claim 10, wherein the cover is connected to the housing and in the closed position when the connector is in the opening, and wherein the cover is not connected to the housing and in the open position when the connector is not in the opening.

12. The combination of claim 11, wherein the connector includes a first vertical portion, a horizontal portion, and a second vertical portion, the first vertical portion extending downwardly from a rear of the cover, the horizontal portion extending from a first end of the first vertical portion in a direction toward a front of the cover, and the second vertical portion extending upwardly from a second end of the horizontal portion.

13. The combination of claim 1, wherein the cover defines a depression therein.

14. The combination of claim 13, wherein the depression is one of substantially circular or polygonal in shape.

15. A combination, comprising:

a chair including an arm rest; and a storage compartment including a housing having a cavity for receiving articles, a cover movable relative to the housing between a closed position, in which the cavity is covered and the cavity is not accessible, and an open position, in which the cavity is not covered and the cavity is accessible, and a locking mechanism connected to at least one of the housing and the cover, and being moveable between a locked condition, in which the cover is in the closed position and is prevented from moving out of the closed position, and an unlocked condition, in which the cover can move between the open and closed positions;

wherein the housing and cover are positionable around the arm rest such that the locking mechanism prevents removal of the storage compartment from the arm rest.

16. The combination of claim 15, wherein the locking mechanism is a combination-style locking mechanism.

17. The combination of claim 15, wherein the cover is pivotably connected to the housing with a hinge and is pivotable about the hinge between the closed and open positions.

18. The combination of claim 15, wherein the cover is selectively removable from the housing, the cover being in the closed position when connected to the housing and being in the open position when removed from the housing.

19. The combination of claim 15, wherein the locking mechanism includes a first locking member supported by one of the housing and the cover and a second locking member supported by the other of the housing and the cover, the first locking member being movable into and out of engagement with the second locking member, the locking mechanism being in the locked condition when the first locking member engages the second locking member and being in the unlocked condition when the first locking member does not engage the second locking member.

20. The combination of claim 19, wherein the first locking member is one of a latch and a projection and the second locking member is the other of the latch and the projection.

21. The combination of claim 20, wherein the latch is rotatable into and out of engagement with the projection.

22. The combination of claim 15, wherein the housing includes an opening and the cover includes a connector, and wherein the connector is removably positionable in the opening to removably connect the cover to the housing.

23. The combination of claim 22, wherein the connector includes a first vertical portion, a horizontal portion, and a second vertical portion, the first vertical portion extending downwardly from a rear of the cover, the horizontal portion extending from a first end of the first vertical portion in a direction toward a front of the cover, and the second vertical portion extending upwardly from a second end of the horizontal portion.

24. The combination of claim 22, wherein the cover is connected to the housing and in the closed position when the connector is in the opening, and wherein the cover is not connected to the housing and in the open position when the connector is not in the opening.

25. The combination of claim 15, wherein openings are defined in opposing sides of at least one of the housing and the cover for receiving the arm rest of the chair.

26. The combination of claim 25, wherein the openings are partially defined in sides of the cover and partially defined in sides of the housing.

27. The combination of claim 25, wherein the openings are defined in sides of the housing.

28. The combination of claim 25, wherein the openings are defined in sides of the cover.

29. A method of locking a storage compartment on an arm rest of a chair, comprising:

providing the storage compartment including a housing, a cover, and a locking mechanism, the housing having a cavity for receiving articles and the cover being movable relative to the housing between a closed position, in which the cavity is covered and the cavity is not accessible, and an open position, in which the cavity is not covered and the cavity is accessible;

positioning the cover and housing around the arm rest of the chair; and locking the cover to the housing with the locking mechanism to prevent removal of the storage compartment from the arm rest.

30. The method of claim 29, wherein openings are defined in opposing sides of at least one of the housing and the cover, and wherein positioning the cover and housing around the arm rest further includes positioning the arm rest in the openings.

31. The method of claim 30, wherein the openings are partially defined in sides of the cover and partially defined in sides of the housing.

32. The method of claim 30, wherein the openings are defined in sides of the housing.

33. The method of claim 30, wherein the openings are defined in sides of the cover.

* * * * *